US008322725B2

(12) United States Patent
Cho

(10) Patent No.: US 8,322,725 B2
(45) **Date of Patent: *Dec. 4, 2012**

(54) HALF MOON TYPE NET

(76) Inventor: Kwang Han Cho, Northridge, CA (US)

( * ) Notice: Subject to any disclaimer, the term of this patent is extended or adjusted under 35 U.S.C. 154(b) by 119 days.

This patent is subject to a terminal disclaimer.

(21) Appl. No.: 12/565,960

(22) Filed: Sep. 24, 2009

(65) Prior Publication Data

US 2011/0070979 A1 Mar. 24, 2011

(51) Int. Cl.
*A63B 63/00* (2006.01)

(52) U.S. Cl. ..... 273/400; 473/476; 473/197; 473/454; 473/422

(58) Field of Classification Search ..... 473/197, 473/422, 454, 476, 478; 273/398–403; D21/705, D21/790

See application file for complete search history.

(56) References Cited

U.S. PATENT DOCUMENTS 5,269,527 A * 12/1993 Noval ..... 473/197
5,569,094 A * 10/1996 Macaluso ..... 473/197
6,190,271 B1 * 2/2001 Rappaport et al. ..... 473/451
7,198,274 B2 * 4/2007 Cho ..... 273/400
7,264,245 B2 * 9/2007 Cho ..... 273/396
2003/0203775 A1 * 10/2003 Wong ..... 473/478
2005/0197212 A1 * 9/2005 Turcot ..... 473/407
2009/0062026 A1 * 3/2009 Cho ..... 473/194

* cited by examiner

*Primary Examiner* — Gene Kim
*Assistant Examiner* — M Chambers
(74) *Attorney, Agent, or Firm* — John K Park; Park Law Firm

(57) ABSTRACT

Disclosed is a half moon type net for catching balls or flexibly stopping the flight of balls, comprising a half-moon-shaped or arch-shaped loop and a fabric retainer to better support the net structure, maintain a bigger net in shape, and reduce the chance of missing balls. More specifically, the net comprises: a main member forming a substantially half-moon-shaped closed loop; a base member forming a closed loop, wherein the straight front section of the base member is connected to the straight bottom section of the main member; a fabric retainer comprising two bottom sections formed adjacent to each of the two corners of the main member and an arch section along the top section of the main member so as to maintain the main member in shape; a fabric member covering the loop of the main member to flexibly stop the flight of projectiles; and a supporting member to sustain the main member against the base member while maintaining a substantial angle between the main and base members.

10 Claims, 5 Drawing Sheets

HALF MOON TYPE NET

BACKGROUND OF THE INVENTION

The present invention relates to a half moon type net for catching balls or flexibly stopping the flight of balls. More particularly, this invention relates to a half moon type net, which comprises a half-moon-shaped or arch-shaped loop and a fabric retainer to better support the net structure, maintain a bigger net in shape, and reduce the chance of missing balls.

The main purpose of screen nets is to practice ball games in a limited space. Screen nets have to have solid structure to capture flying balls and resist the impact of flying balls. In addition, the loop structure of screen net has to be such as to increase the chance to capture even mistakenly thrown balls or at least not to miss properly thrown balls. Increasing the size of net and reinforcing the structure are not proper solution because the size and structure of screen nets are limited due to its purpose to practice balls in a limited space. Thus, there has been a demand for better screen net structure for better performance of screen nets.

Conventional screen nets on the market are rectangular or polygon shaped. Using the same length of loop, circular shaped net can cover greater area than rectangular or polygon shaped net. Additionally, statistically circular shape has better chance to capture even mistakenly thrown balls than rectangular or polygon shape if they have the same area. Therefore, circular shape or arch shape has better performance as screen nets than rectangular or polygon shape.

Accordingly, a need for a half moon type net has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a half moon type net for catching balls or flexibly stopping the flight of balls.

Another object of the invention is to provide a half moon type net, which comprises a half-moon-shaped or arch-shaped loop and a fabric retainer to better support the net structure, maintain a bigger net in shape, and reduce the chance of missing balls.

Still another object of the invention is to provide a half moon type net, which comprises a substantially half-moon-shaped closed loop with rounded bottom sections and a fabric retainer comprising two bottom sections formed adjacent to each of the two corners and an arch section along the arch of the loop so as to maintain the half moon type net in shape.

An aspect of the invention provides a half moon type net comprising: a main member forming a substantially half-moon-shaped closed loop, wherein the main member is defined by a top section and a bottom section, wherein the top section is substantially arch-shaped, the bottom section is straight and two corners are rounded; a base member forming a closed loop, wherein the base member is defined by a front section and a non-front section, wherein the front section is attached to the bottom section of the main member; a fabric retainer comprising two bottom sections formed adjacent to each of the two corners and an arch section along the top section of the main member so as to maintain the main member in shape; a fabric member having a front section and a non-front section, wherein the front section of the fabric member is connected to the main member to flexibly stop the flight of projectiles; and a supporting member to sustain the main member against the base member while maintaining a substantial angle between the main and base members.

The advantages of the present invention are: (1) the half moon type net can better support the net structure; (2) the half moon type net can maintain a bigger net in shape; and (3) the half moon type net can increase the chance to capture even mistakenly thrown balls or at least not to miss properly thrown balls.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 6:
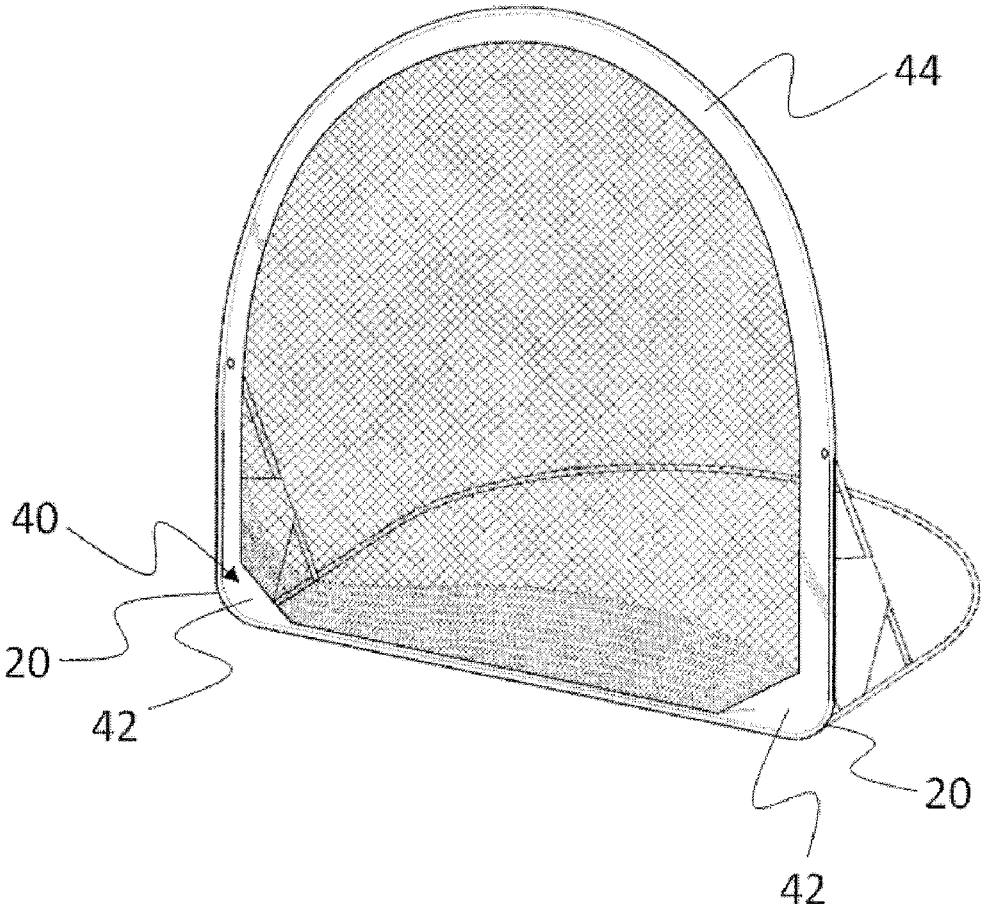
FIG. 6 is a perspective view showing a half moon type net according to another embodiment of the present invention.
Figure 7:
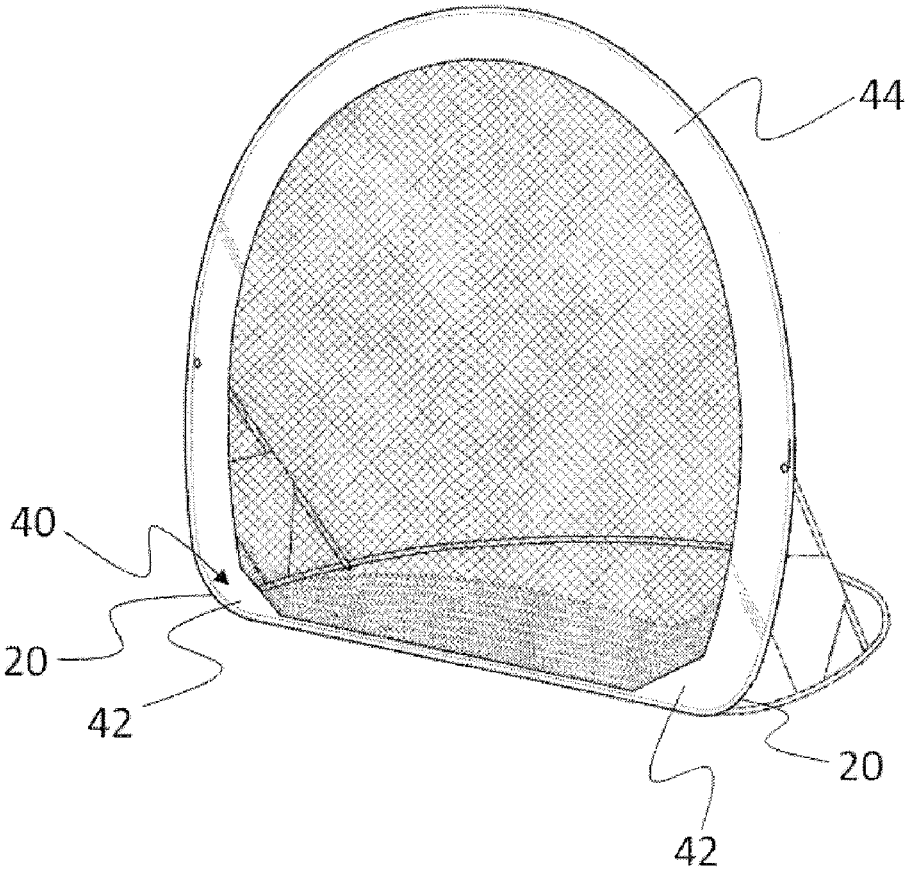
FIG. 7 is a perspective view showing a half moon type net according to still another embodiment of the present invention.

FIGS. 1-5 show a half moon type net 10 according to an embodiment of the present invention. FIGS. 6-7 show a half moon type net 10 according to another embodiment of the invention.

Figure 1:
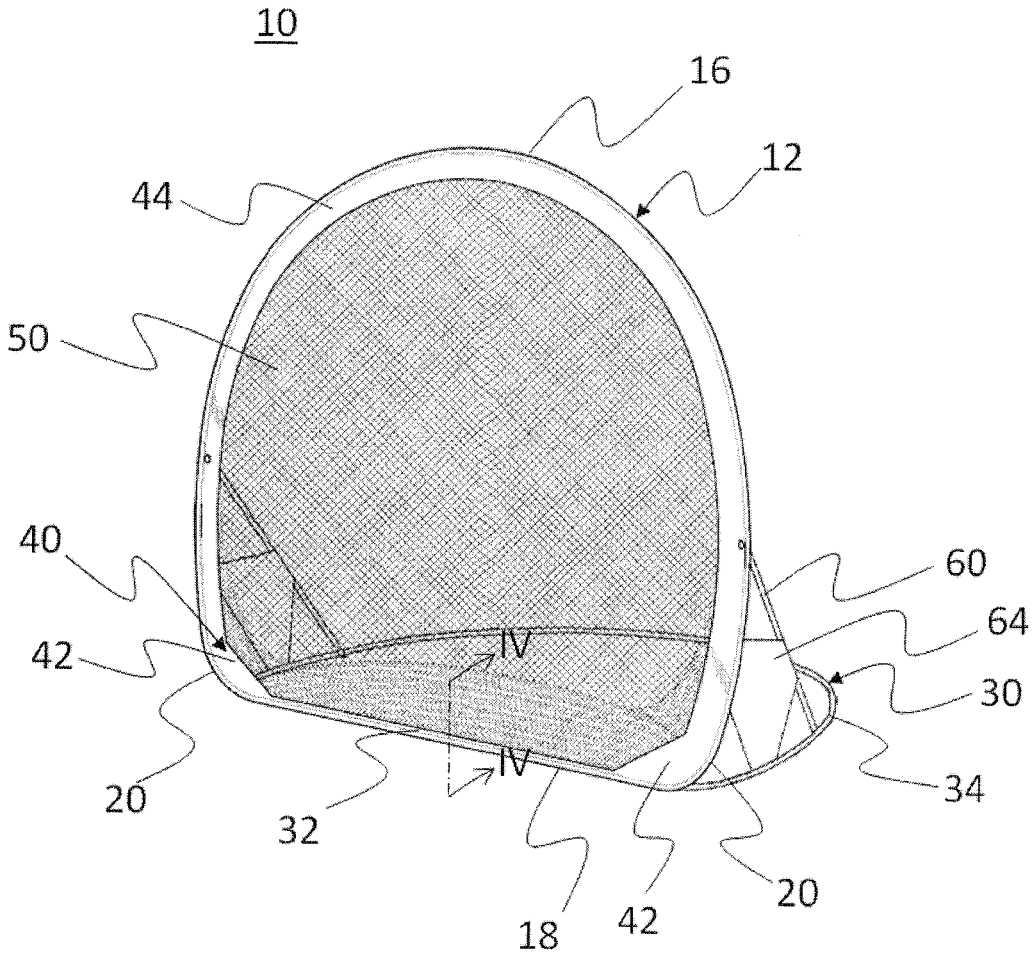
FIG. 1 is a perspective view showing a half moon type net according to an embodiment of the present invention.

FIG. 1 shows a perspective view of a half moon type net 10. As shown therein, the half moon type net comprises: a main member 12 forming a substantially half-moon-shaped closed loop 14, wherein the main member 12 is defined by a top section 16 and a bottom section 18, wherein the top section 16 is substantially arch-shaped, the bottom section 18 is straight and two corners 20 are rounded; a base member 30 forming a closed loop, wherein the base member 30 is defined by a front section 32 and a non-front section 34, wherein the front section 32 is attached to the bottom section 18 of the main member 12; a fabric retainer 40 comprising two bottom sections 42 formed adjacent to each of the two corners 20 of the main member 12 and an arch section 44 along the top section 16 of the main member 12 so as to maintain the main member 12 in shape; a fabric member 50 having a front section 52 and a non-front section 54, wherein the front section 52 of the fabric member 50 is connected to the main member 12 to flexibly stop the flight of projectiles; and a supporting member 60 to sustain the main member 12 against the base member 30 while maintaining a substantial angle between the main 12 and base members 30.

Half-moon-shaped or arch-shaped loop has advantages over rectangular or polygon-shaped net for at least two reasons. First, according to geometric calculations, using the same length of loop, circular or arch shape can cover greater area than rectangular or polygon shape. Second, circular or arch shape can increase the chance to capture mistakenly thrown balls compared to rectangular or polygon shape assuming that both shapes have the same area. When a person throws a ball at a target, the probability that the ball hits the target is greatest and the farther a certain point is from the target, the lower the probability of hitting that point. This means distribution diagram of probability becomes a circular shape and this is why circular shape can cover greatest chance to capture a flying ball. If this circular shape is combined with a straight bottom section 18 of the main member 12, arch shape logically results for the greatest chance of capturing balls.

The fabric retainer 40 supports and maintains the main member 12 in shape. The wide area of the two bottom sections 42 of the fabric retainer 40 reinforces the stable structure of the main member 12 and the arch section 44 of the fabric retainer 40 also helps maintain the main member 12 in shape. The arch section 44 has a designated width and this width can be adjusted.

The base member 30 may form a substantially half-moon-shaped closed loop, wherein the non-front section 34 of the base member 30 is substantially arch-shaped. Preferably, the base member 30 and the main member 12 are substantially in the same shape and this will help in making both members coilably overlapping loops.

Figure 2:
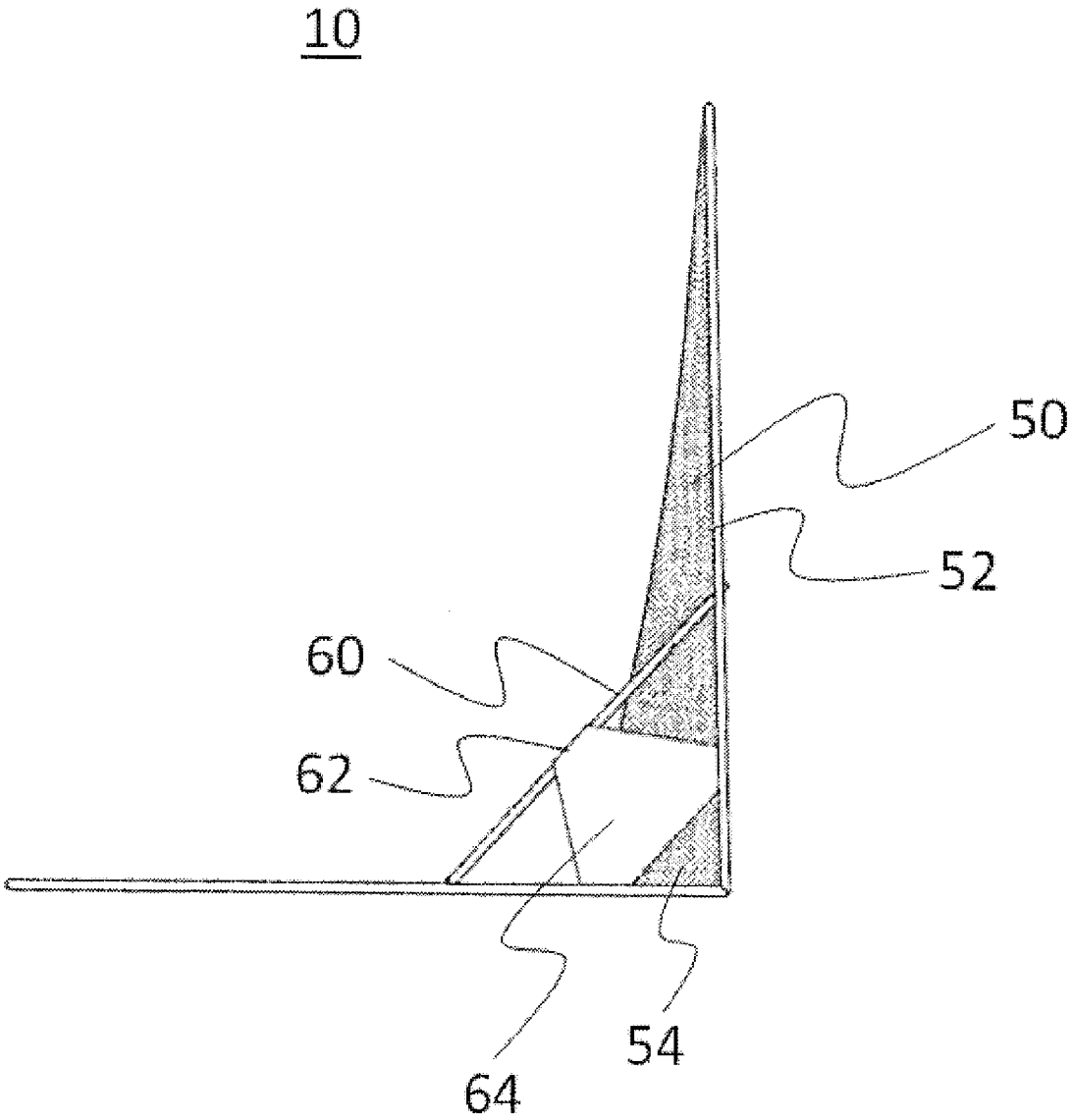
FIG. 2 is a side view showing a half moon type net according to an embodiment of the present invention.

FIG. 2 shows a side view of the half moon type net. The half moon type net 10 may additionally comprise a patch 64 attachedly sided to the main 12 and base members 30, wherein the patch has a guide 62 to support the supporting member. The guide 62 may be a sleeve to allow passage of the supporting member 60.

Figure 3:
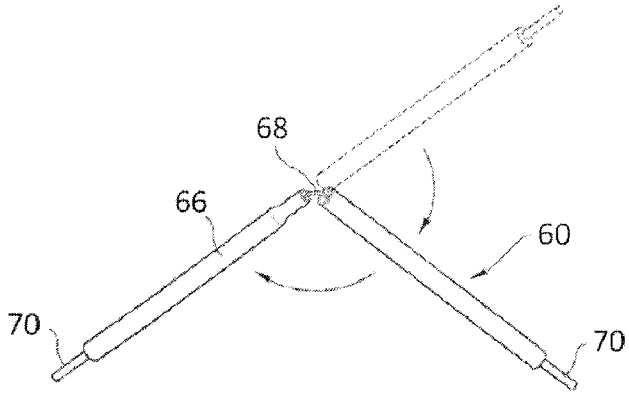
FIG. 3 is a constructive view showing a supporting member in FIG. 1.

As further shown in FIG. 3, the supporting member 60 may comprise a pair of rods 66 whose ends become removably, correspondingly carried in the holes of main and base members 12, 30. The rods 66 are each elastically detachable to two pieces which remain connected by an elastic string 68 provided in the respective rods. This way, the supporting member 60 can be easily dissembled to smaller pieces to facilitate storage.

The fabric member 34 is to catch or flexibly stop the flight of balls. The front section 52 of the fabric member 50 is connected to the front section 32 of the base member 30. The non-front section 54 of the fabric member 50 may be draped down without being connected to any or may be connected to the non-front section 34 of the base member 30.

Figure 4:
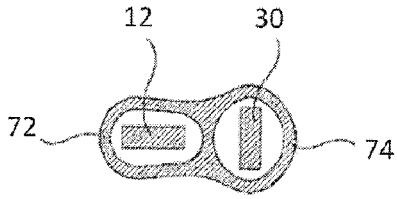
FIG. 4 is a cross-sectional view taken along IV-IV in FIG. 1.

FIG. 4 shows a cross-sectional view taken along IV-IV in FIG. 1. The main and base members 12, 30 are each fabric-covered so that the main member is carried in a main sleeve 72, and the base member 30 is carried in the base sleeve 74. The main sleeve 72 may have main holes and the base sleeve 74 may have base holes so that the main and base holes removably carry therein ends of the supporting member 60.

Figure 5:
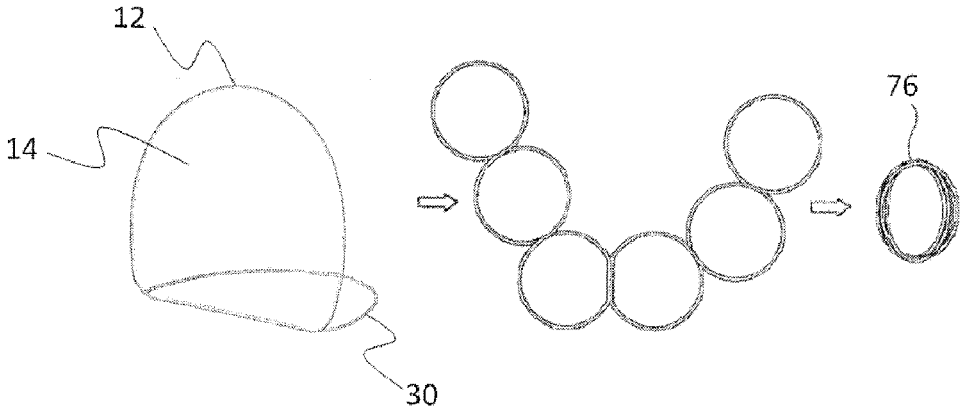
FIG. 5 is a schematic view showing a coiling mechanism of the half moon type net.

FIG. 5 shows a storage mechanism applied to the half moon type net 10. As shown therein, for better storage and dissembling purposes, the main and base members 12, 30 are each formed in a coilable format so that the main and base members 12, 30 are each coilable to overlapping loops 76. Preferably, the main and base members 12, 30 are each coiled in twofold or threefold to the overlapping loops 76 to facilitate storage and portability. For assembly into the usable net device 10, the overlapped loops 76 can be simply released for elastic pop-up setting to the polygonal formation. Then, the main member 12 is raised and supported by the supporting member 60 carried in the patch sleeve 62.

The main and base members 12, 30 may be formed of an elastic material so as to facilitate the assembly and the coiled overlapping for disassembly. For disassembly of the half moon type net 10, the supporting member 60 can be simply removed, and the main and base members 12, 30 are twisted and coiled into a plurality of overlapping loops 76. Accordingly, the pair of coiled members 12, 30 can be easily stored in the storage bag.

FIG. 6 shows alternative embodiment of the present invention 10. The major feature of this embodiment is that the lower part of the top section 16 of the main member 12 is substantially straight, making higher the height of the half moon type net 10. Due to these straight lines, two corners 20 of the bottom section 18 of the main member 12 have become stiffer or rounder. In this structure, the net can be higher, covering wider area for flexibly stopping the flight of balls. Thus, this embodiment of the half moon type net 10 comprises: a main member 12 forming a substantially half-moon-shaped closed loop 14, wherein the main member 12 is defined by a top section 16 and a bottom section 18, wherein the top section 16 is substantially arch-shaped, the bottom section 18 is straight and two corners 20 are rounded, wherein the lower part of the top section 16 of the main member 12 is substantially straight, making the curve of the two corners 20 stiffer, in order to support higher top section 16 of the main member 12; a base member 30 forming a closed loop, wherein the base member 30 is defined by a front section 32 and a non-front section 34, wherein the front section 32 is attached to the bottom section 18 of the main member 12; a fabric retainer 40 comprising two bottom sections 42 formed adjacent to each of the two corners 20 of the main member 12 and an arch section 44 along the top section 16 of the main member 12 so as to maintain the main member in shape; a fabric member 50 having a front section 52 and a non-front section 54, wherein the front section 52 of the fabric member 50 is connected to the main member 12 to flexibly stop the flight of projectiles; and a supporting member 60 to sustain the main member 12 against the base member 30 while maintaining a substantial angle between the main 12 and base members 30.

FIG. 7 shows still another embodiment of the half moon type net 10. The major features of this embodiment is that here, the arch section 44 of the fabric retainer 40 is wider so as to support bigger net. All the additional limitations of the first embodiment also apply to the alternative embodiments.

Still, another embodiment of the half moon type net 10 comprises a main member 12 forming a substantially half-moon-shaped closed loop 14, wherein the main member 12 is defined by a top section 16 and a bottom section 18, wherein the top section 16 is substantially semi-circular, the bottom section 18 is straight and two corners 20 are rounded, wherein the lower part of the top section 16 of the main member 12 is substantially straight, making the angle between the bottom section 18 of the main member 12 and the lower part of the top section 16 of the main member 12 substantially a right angle (an angle of 90 degrees), in order to support higher top section of the main member; a base member 30 forming a closed loop, wherein the base member 30 is defined by a front section 32 and a non-front section 34, wherein the front section 32 is attached to the bottom section 18 of the main member 12; a fabric retainer 40 comprising two bottom sections 42 formed adjacent to each of the two corners 20 of the main member 12 and an arch section 44 along the top section 16 of the main member 12 so as to maintain the main member 12 in shape; a fabric member 50 having a front section 52 and a non-front section 54, wherein the front section 52 of the fabric member 50 is connected to the main member 12 to flexibly stop the flight of projectiles; and a supporting member 60 to sustain the main member 12 against the base member 30 while maintaining a substantial angle between the main 12 and base members 30. All the additional limitations of the first embodiment also apply to the alternative embodiments.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A half moon type net comprising:

a main member forming a substantially half-moon-shaped closed loop, wherein the main member is defined by a top section and a bottom section, wherein the top section is substantially arch-shaped, the bottom section is straight and two corners are rounded, wherein each corner connects a round end of the arch-shaped top section and a straight end of the bottom section such that a tangential line of the round end of the arch-shaped top section meets an extension of the straight end of the bottom section by an angle larger than a right angle;

a base member forming a closed loop, wherein the base member is defined by a front section and a non-front section, wherein the front section is attached to the bottom section of the main member;

a fabric retainer comprising two bottom sections formed adjacent to each of the two corners of the main member and an arch section along the top section of the main member so as to maintain the main member in shape;

a fabric member having a front section and a non-front section, wherein the front section of the fabric member is connected to the main member to flexibly stop the flight of projectiles;

a supporting member to sustain the main member against the base member while maintaining a substantial angle between the main and base members; and a patch attachedly sided to the main and base members, wherein the patch has a guide to support the supporting member.

2. The half moon type net of claim 1, wherein the supporting member is a pair of rods whose ends become removably, correspondingly carried in the main and base holes.

3. The half moon type net of claim 2, wherein the rods are each elastically detachable to two pieces which remain connected by an elastic string provided in the respective rods.

4. The half moon type net of claim 1 further comprising:

a main sleeve substantially covering the main member; and a base sleeve substantially covering the base member.

5. The half moon type net of claim 4, wherein the main sleeve has main holes and the base sleeve has base holes, wherein the main and base holes removably carry therein ends of the supporting member.

6. The half moon type net of claim 1, wherein the main and base members are each coilable.

7. The half moon type net of claim 6, wherein the main and base members are each coilable to overlapping loops.

8. The half moon type net of claim 1, wherein the base member forms a substantially half-moon-shaped closed loop, wherein the non-front section of the base member is substantially arch-shaped.

9. The half moon type net of claim 1, wherein the non-front section of the fabric member is connected to the non-front section of the base member.

10. The half moon type net of claim 1, wherein the guide is a sleeve to allow passage of the supporting member.

* * * * *